United States Patent [19]

Humphrey

[11] Patent Number: 4,954,094

[45] Date of Patent: Sep. 4, 1990

[54] SLIDING GIMBAL CONNECTOR

[75] Inventor: James C. Humphrey, Russell, Pa.

[73] Assignee: GTE Products Corporation, Stamford, Conn.

[21] Appl. No.: 407,826

[22] Filed: Sep. 15, 1989

[51] Int. Cl.[5] ..... H01R 13/64

[52] U.S. Cl. ..... 439/247; 248/184

[58] Field of Search ..... 439/6, 240, 247, 248; 248/184; 403/13, 14, 57

[56] References Cited

U.S. PATENT DOCUMENTS

| | | | |
|---|---|---|---|
| 2,438,371 | 3/1948 | Marholz | 439/247 |
| 3,964,814 | 6/1976 | Kalbitz et al. | 439/248 |
| 4,362,413 | 12/1982 | Heard et al. | 403/14 |
| 4,898,541 | 2/1990 | Laviller | 439/248 |

*Primary Examiner*—Eugene F. Desmond

*Attorney, Agent, or Firm*—William H. McNeill

[57] ABSTRACT

A sliding gimbal comprises a first hollow mounting frame having an inner surface and an outer surface with at least one mounting member associated with the outer surface. A pair of oppositely disposed stud receiving slots is formed on the first frame inner surface, and this pair of slots is elongated. A second hollow mounting frame having an inner surface and an outer surface and including a pair of oppositely disposed cylindrical studs projecting therefrom is mounted within the first frame with the studs engaging the slots. A pair of oppositely disposed protuberance receiving slots is formed in the second frame inner surface, this pair of protuberance receiving slots being also elongated and being formed in surfaces adjacent to and orthogonal to the second frame outer surfaces carrying the cylindrical studs; An article mounted within the second hollow mounting frame comprises a body carrying a pair of oppositely disposed cylindrical protuberances on body outer walls which engage the pair of oppositely disposed protuberance receiving slots. The article is preferably one half of an electrical connector. The employment of the cylindrical studs in the elongated slots allows pivotal movement about the stud axis and sliding movement which is virtually frictionless.

6 Claims, 1 Drawing Sheet

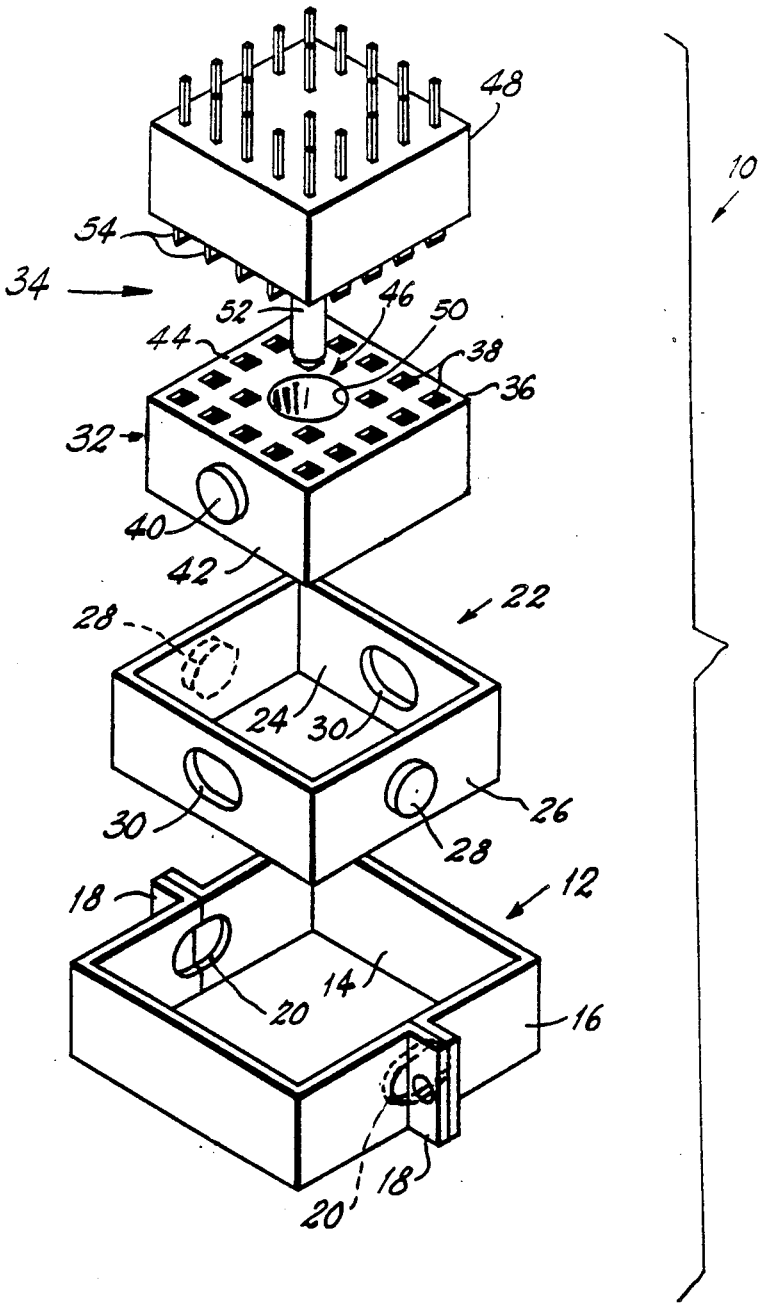
48
10
54
34
52
46
50
44
38
36
32
40
42
22
28
24
30
30
26
28
18
12
14
20
16
18
20

SLIDING GIMBAL CONNECTOR

TECHNICAL FIELD

This invention relates to gimbals and more particularly to sliding gimbals. Still more particularly, it relates to such gimbals for mounting electrical connectors.

BACKGROUND ART

Gimbals generally are mounted for rotational movement. Floating gimbals rely on full contact sliding surfaces to achieve planar movement, and dimensional looseness to achieve rotary movement. Such systems suffer from increased frictional forces and lack of precision which makes them unsuitable for many applications; e.g., where one component is fixed and another is attached to a hinged or sliding member.

SUMMARY OF THE INVENTION

It is, therefore, an object of the invention to obviate the disadvantages of the prior art.

It is another object of the invention to enhance gimbals.

Still another object of the invention is the provision of a sliding gimbal suitable for use with electrical connectors.

These objects are accomplished, in one aspect of the invention, by the provision of a sliding gimbal comprising a first hollow mounting frame having an inner surface and an outer surface. At least one mounting member is associated with the outer surface. A pair of oppositely disposed stud receiving slots is formed on the first frame inner surface. The pair of slots is elongated. A second hollow mounting frame has an inner surface and an outer surface with a pair of oppositely disposed cylindrical studs projecting therefrom and engaging the first pair of slots formed on the inner surface of the first mounting frame when the second frame is mounted within the first frame. A pair of oppositely disposed protuberance receiving slots is formed in the second frame inner surface, the pair of protuberance receiving slots being also elongated and being formed in surfaces adjacent to and orthogonal to the second frame outer surfaces carrying the cylindrical studs. An article is mounted within the second hollow mounting frame, and comprises a body carrying a pair of oppositely disposed cylindrical protuberances which engage the pair of oppositely disposed protuberance receiving slots.

The sliding gimbal thus provided obviates the disadvantages of the prior art. The elongated slots allow planar movement of the inner frame and article, and, because there is minimal area contact between the studs and slots, since the studs are cylindrical, frictional forces are reduced. The cylindrical studs (and protuberances) also permit rotational movement.

BRIEF DESCRIPTION OF THE DRAWING

The single Figure is an exploded perspective view of an embodiment of the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawing.

Referring now to the drawing with greater particularity, there is shown a gimballed electrical connector 10 comprised of a first hollow mounting frame 12 having an inner surface 14 and an outer surface 16. At least one mounting member 18, which can be in the form of a projecting ear, is formed on the outer surface 16. In the illustrated embodiment the ears can be utilized for holding together two halves of first frame 12 as well as for fixing the gimballed assembly in its operating position (not shown).

A pair of oppositely disposed, elongated stud receiving slots 20 are formed on first frame inner surface 14, preferably with semi-circular ends. A second hollow mounting frame 22 is provided for fitting within first frame 12. The second frame 22 has an inner surface 24, and an outer surface 26 which carries oppositely disposed, cylindrical studs 28 projecting therefrom. The studs 28 engage the slots 20. The inner surface 24 of second frame 22 is provided with oppositely disposed protuberance receiving slots 30, these slots 30 being elongated and and being formed in walls of frame 22 which are adjacent to and orthogonal to the walls carrying the studs 28.

A first half 32 of an electrical connector 34 is mounted within the second frame 22. The first half 32 comprises a body 36 carrying electrical contacts 38, which in this instance are shown as being female contacts, and has a pair of oppositely disposed protuberances 40 extending from walls 42. These protuberances engage the protuberance receiving slots 30 formed in second frame 22. The body 36 has a surface 44 which is transverse to the outer body walls and this latter surface carries connector aligning means 46 for aligning the second half 48 of connector 34. In the embodiment illustrated, the aligning means in half 32 comprises a tapered aperature 50 which cooperates with a prong 52 on the second half 48. It will be apparent from the drawing that the second half 48 of connector 34 carries male electrical contacts 54 for mating with the female contacts 38 of the first half 32. This is exemplary only, and the contacts, as well as the aligning means can be reversed.

When assembled, it will be seen that the connector half 32 has a degree of planar sliding movement in a first direction by virtue of the protuberances 40 being ensconced in the elongated protuberance receiving slots 30. Pivotal movement occurs around the longitudinal axis of the cylindrical protuberances 40.

Likewise, the second frame 22 has a degree of planar sliding movement because of the engagement of the cylindrical studs 28 with the elongated stud receiving slots 20 formed with first frame 12. Pivotal movement occurs around the longitudinal axis of the studs.

This sliding gimbal connector can be employed in many different applications but is especially suited for use where one of the connector halves, for example, the gimballed half 32, is mounted upon a more or less fixed substrate while the free or second half 48 is mounted upon a relatively movable or hinged structure. The degree of movement allowed by the gimbal, operating together with the alignment means, assures efficient mating of the electrical connector 34, even if some variance occurs between the movement of the hinged part and the fixed part.

Accordingly, there is here provided a new connector mounting means which employs a sliding gimbal with reduced friction and which obviates the disadvantages of the prior art.

While there have been shown what are at present considered to be the preferred embodiments of the invention, it will be apparent to those skilled in the art that various changes and modifications can be made herein without departing from the scope of the invention as defined by the appended claims.

I claim:

1. A gimballed electrical connector comprising;

a. a first hollow mounting frame having an inner surface and an outer surface;

b. at least one mounting member on said outer surface;

c. a pair of oppositely disposed stud receiving slots formed on said first frame inner surface, said pair of slots being elongated;

d. a second hollow mounting frame having an inner surface and an outer surface;

e. a pair of oppositely disposed cylindrical studs projecting from said second frame outer surface and engaging said first pair of slots formed on the inner surface of said first mounting frame when said second frame is mounted within said first frame;

f. a pair of oppositely disposed protuberance receiving slots formed in said second frame inner surface, said pair of protuberance receiving slots being elongated and being formed in surfaces adjacent to and orthogonal to said second frame outer surfaces carrying said cylindrical studs; and g. a first half of an electrical connector mounted within said second hollow mounting frame, said first half of said electrical connector comprising a body carrying electrical contacts, a pair of opposite disposed cylindrical protuberances on body outer walls which engage said pair of oppositely disposed protuberance receiving slots, said body further having a surface transverse to said body outer walls, said transverse surface carrying connector aligning means for aligning the second half of said connector.

2. The gimballed electrical connector of claim 1 wherein said first hollow mounting frame, said second hollow mounting frame, and said first half of said electrical connector are quadrangular.

3. The gimballed electrical connector of claim 1 wherein said pair of stud receiving slots and said pair of protuberance receiving slots have semi-circular ends.

4. The gimballed electrical connector of claim 1 wherein said aligning means carried by said transverse surface of said first connector half comprises a tapered aperture and said mating second half of said electrical connector carries a cylindrical prong.

5. A sliding gimbal comprising;

a. a first hollow mounting frame having an inner surface and an outer surface;

b. at least one mounting member on said outer surface;

c. a pair of oppositely disposed stud receiving slots formed on said first frame inner surface, said pair of slots being elongated;

d. a second hollow mounting frame having an inner surface and an outer surface;

e. a pair of oppositely disposed cylindrical studs projecting from said second frame outer surface and engaging said first pair of slots formed on the inner surface of said first mounting frame when said second frame is mounted within said first frame;

f. a pair of oppositely disposed protuberance receiving slots formed in said second frame inner surface, said pair of protuberance receiving slots being elongated and being formed in surfaces adjacent to and orthogonal to said second frame outer surfaces carrying said cylindrical studs; and g. an article mounted within said second hollow mounting frame, said article comprising a body carrying a pair of oppositely disposed cylindrical protuberances on body outer walls which engage said pair of oppositely disposed protuberance receiving slots.

6. The gimbal of claim 5 wherein said body further has a surface transverse to said body outer walls, said transverse surface carrying aligning means for aligning a second half of said article.

* * * * *